US012121067B2

(12) United States Patent
Hupkes

(10) Patent No.: US 12,121,067 B2
(45) Date of Patent: Oct. 22, 2024

(54) AEROSOL GENERATING DEVICE

(71) Applicant: JT International SA, Geneva (CH)

(72) Inventor: Ernst Hupkes, Kampen (NL)

(73) Assignee: JT International SA (CH)

( * ) Notice: Subject to any disclaimer, the term of this patent is extended or adjusted under 35 U.S.C. 154(b) by 340 days.

(21) Appl. No.: 17/632,724

(22) PCT Filed: Aug. 6, 2020

(86) PCT No.: PCT/EP2020/072191
§ 371 (c)(1),
(2) Date: Feb. 3, 2022

(87) PCT Pub. No.: WO2021/023842
PCT Pub. Date: Feb. 11, 2021

(65) Prior Publication Data

US 2022/0279851 A1 Sep. 8, 2022

(30) Foreign Application Priority Data

Aug. 8, 2019 (EP) ..... 19190875

(51) Int. Cl.
*A24F 13/00* (2006.01)
*A24F 40/42* (2020.01)
*A24F 40/46* (2020.01)

(52) U.S. Cl.
CPC ..... *A24F 40/46* (2020.01); *A24F 40/42* (2020.01)

(58) Field of Classification Search
CPC ..... A24F 47/00
USPC ..... 131/328–329
See application file for complete search history.

(56) References Cited

U.S. PATENT DOCUMENTS 5,743,251 A * 4/1998 Howell ..... A61M 11/001 239/10
10,206,430 B2 2/2019 Mironov et al.
2013/0042865 A1 2/2013 Monsees et al.
2017/0071251 A1 3/2017 Goch
2017/0119054 A1 5/2017 Zinovik et al.
2018/0007961 A1 1/2018 Zhu

FOREIGN PATENT DOCUMENTS

CN 105342014 A 2/2016
CN 106163309 A 11/2016
CN 107568798 A 1/2018
CN 109561736 A 4/2019
(Continued)

OTHER PUBLICATIONS

International Search Report for PCT/EP2020/072191 dated Oct. 29, 2020. 3 pages.

(Continued)

*Primary Examiner* — Phuong K Dinh
(74) *Attorney, Agent, or Firm* — Lerner David LLP

(57) ABSTRACT

An aerosol generating device includes a tubular heating chamber for heating aerosol generating material contained within the chamber, an insulating tube at least partially sleeved around the tubular heating member and at least one annular support for supporting the heating chamber within the insulating tube. At least a portion of the inner annular support is mounted within the insulating tube, and the heating chamber is at least partially mounted within the annular support.

15 Claims, 8 Drawing Sheets

(56) References Cited

FOREIGN PATENT DOCUMENTS

| | | | |
|---|---|---|---|
| EP | 3530130 | B1 | 8/2020 |
| GB | 2515502 | A | 12/2014 |
| JP | 2014524313 | A | 9/2014 |
| JP | 2017511703 | A | 4/2017 |
| WO | 9920939 | A1 | 4/1999 |
| WO | 2018046946 | A1 | 3/2018 |

OTHER PUBLICATIONS

Search Report of Taiwanese Application No. 109126919 completed Nov. 14, 2023. 1 pg.
Search Report dated Mar. 13, 2024 from the Office Action for Chinese Application No. 202080056373.4 issued Mar. 20, 2024, 3 pages.

* cited by examiner

AEROSOL GENERATING DEVICE

CROSS-REFERENCE TO RELATED APPLICATIONS

The present application is a national phase entry under 35 U.S.C. § 371 of International Application No. PCT/EP2020/072191, filed Aug. 6, 2020, published in English, which claims priority to European Application No. 19190875.5 filed Aug. 8, 2019, the disclosures of which are incorporated herein by reference.

BACKGROUND OF THE INVENTION

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the rage 150° C. to 300° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

In such aerosol generation devices, the aerosol substrate must be heated by a heater and it is inevitable that some heat will leak from the heater into the rest of the aerosol generation device. This heat may damage other components such as a power source of the heater or heat-sensitive electronics. In some cases, this may even be dangerous with risk of fire or explosion when components that are not designed to be heated become too hot. Furthermore, this leakage of heat can result in the outer surface of the device becoming too hot for the user to hold comfortably in their hands, and, if left uncontrolled, can even present a hazard to the user's skin.

It is therefore desirable to provide a device with improved safety and/or reliability, whilst maintaining or improving the various advantages associated with such heat-not-burn devices.

SUMMARY OF THE INVENTION

According to a first aspect there is provided an aerosol generating device comprising a heater assembly and a frame configured to hold the heater assembly; the heater assembly comprising: a tubular heating chamber for heating aerosol generating material contained within the chamber; an insulating tube at least partially sleeved around the tubular heating chamber; and at least one annular support for supporting the heating chamber within the insulating tube, wherein at least a portion of the annular support is mounted within the insulating tube, and the heating chamber is at least partially mounted within the annular support and wherein the annular support is positioned at one end of the insulating tube and is configured to be mounted to the frame.

By having annular supports mounted as such, the aerosol generating device can provide effective heating to the aerosol generating material contained in the chamber whilst reducing the leakage of heat from the chamber. An annular support provides reliable structure to both hold the heating chamber within the insulating tube and the heater assembly to the frame to increase safety and reliability of the device, and to reduce the level of heat transferred from the heating chamber to the rest of the device and in particular to the surface of the device.

In particular, the annular support may comprise one or more protrusions extending into the insulating tube to engage an outer surface of the heating chamber. The protrusions may provide regions of reduced surface area, such that the points of connection between the annular support and the heating chamber can be reduced. By minimising the required physical direct contact between the annular support and the heating chamber, it is possible to further reduce the transfer of heat from the chamber to the support, and ultimately to the rest of the device.

Preferably, the heating chamber is at least partially mounted within the portion of the annular support which is mounted within the insulating tube. In such a case, the annular support can provide a single portion which is inserted between the insulation tube and the heating chamber to support the heating chamber in the insulation tube, and the same support portion contacts the insulation tube and the heating chamber.

Preferably, the heater assembly may comprise an annular support at each end of the insulating tube. Most preferably, the heater assembly may be free of any annular support between the annular supports at each end of the insulating tube. As a result, the possible heat transfer to the rest of the device, in particular the outer housing can be reduced. A relatively free space between the insulating tube and the outer housing may so be created which may provide further efficient insulation against possible heat transferred by the annular supports to the outer surface of the insulating tube. Since the annular supports are also positioned at the ends of the heater assembly, the heat transfer is limited as such zone are less heated than the more central zone of the heating chamber.

In a possible mode, the inner annular support may have a C-shaped cross section. By having an annular cross-section which does not constitute a full, or closed, circumferential line, it is possible to reduce the material required which leads to a further reduction in transfer of heat, as well as reduced cost of manufacture.

In particular, at least one annular support in the device as defined previously may be an outer annular support which engages an outer surface of the insulating tube. The at least one outer annular support provides structure to engage the outer surface of the insulating tube, and the outer annular support may provide support for the insulating tube within the device as a whole. For example the outer annular support may provide support for the insulating tube to be held against a casing or a frame within the device. Additionally, the outer annular support may provide a form of direct or indirect connection between components interior to the insulating tube, such as the heating chamber, and the exterior surface of the insulating tube.

The outer annular support may have the same or a similar structure to the other annular supports. Optionally, the outer annular support may comprise a first support component and a second support component, wherein the first support component engages a portion of the outer surface of the insulating tube; the second support component engages a portion of the outer surface of heating chamber within the insulating tube; and the first support component and the second support component engage each other at one or more contact points. By forming the outer annular support from two or more separate components engaged at a contact point, it is possible to reduce the transfer of heat from the heating chamber through to the insulating tube. The contact points may be designed so as to reduce or minimise the transfer of heat between the two components. The contact points may be any one of points, lines, arcs, or sections of annular forms. That is, the first support component and the second support component may engage each other along a contact line.

In particular, at least one annular support may be an inner annular support which only contacts the insulating tube on its inner surface. By engaging the insulating tube at an inner surface of the tube, the inner annular support can provide a structure which reduces the transfer of heat from the chamber to the exterior of the tube. This arrangement may also increase the potential air gap between the insulating tube and the outer housing.

In particular, the device may comprise a first annular support at a first end of the insulating tube, and a second annular support at a second end of the insulating tube. The device may comprise an inner annular support at a first end of the insulating tube, and an outer annular support at a second end of the insulating tube. The device may comprise at least one outer annular support at each end of the insulating tube. The device may comprise at least one inner annular support at each end of the insulating tube. By including an annular support (inner, outer or otherwise), at the ends of the insulating tube in any of the manners described above, it is possible to provide an even more secure structural support for the heating chamber and insulating tube whilst minimising the transfer of heat to the rest of the device.

Preferably, at least one annular support may comprise a connection member for securing the heater assembly to the frame. By having the connection member attached to or formed as part of the annular support, it is possible to avoid direct contact of the other components of the heater assembly (such as the heating chamber or the insulating tube) to the frame.

Whilst the connection member may take any suitable form, preferably, the connection member may comprise an aperture arranged to receive one or more pins provided on the frame. The aperture, or apertures, may allow the annular support to connect to the frame through a slotting connection, wherein a pin provided on the frame may be slotted into the aperture. The slotting connection may itself be a permanent connection, or alternatively the connection may be made permanent by means of adhesives or other means to once the pins have been slotted into the apertures. It is to be noted that the arrangement of apertures and pins may be reversed, in that the apertures may be present on the frame and the connection member on the annular support may be apertures arranged to receive the pins. Alternatively, the annular support may comprise a mixture of apertures and pins for engaging pins and apertures provided on the frame.

The heating chamber may provide heat to the aerosol generating material contained within by any suitable means. Generally, heat may be provided by resistive heating, inductive heating or contact heating. Typically, the aerosol generating device may comprise a thin film heater wrapped around the outer surface of the tubular heating chamber. A thin film heater can provide a flexible yet effective source of heat which can be applied to a tubular heating chamber in a safe and reliable way.

The tubular heating chamber may comprise an open end for receiving aerosol generating material, or a consumable comprising aerosol generating material, in to the chamber, and a closed end forming a terminal base opposite to the open end. In other words, the tubular heating chamber may generally take the form of a hollow cylinder having one open end, so as to provide an opening through which a user can place aerosol generating material, but which is otherwise enclosed so as to provide a generally enclosed volume in which heat provided to the heating chamber is contained. When the aerosol generating material is inserted into the heating chamber, the placement of the aerosol generating material may restrict or close the open end of the heating chamber. In some examples a consumable comprising aerosol generating material may be provided in a generally cylindrical form which matches the inner volume of the heating chamber.

Typically, the at least one annular support may be formed from polyether ether ketone (PEEK). PEEK is a highly temperature resistant material, which is ideal for use in components arranged near a source of heat. When used in components directly in contact with the heating components (e.g. the heating chamber), PEEK reduces the heat conduction to other components in the device.

BRIEF DESCRIPTION OF THE DRAWINGS

An example aerosol generating device will now be described by way of example with reference to the accompanying drawings, in which.

DETAILED DESCRIPTION

Figure 1A:
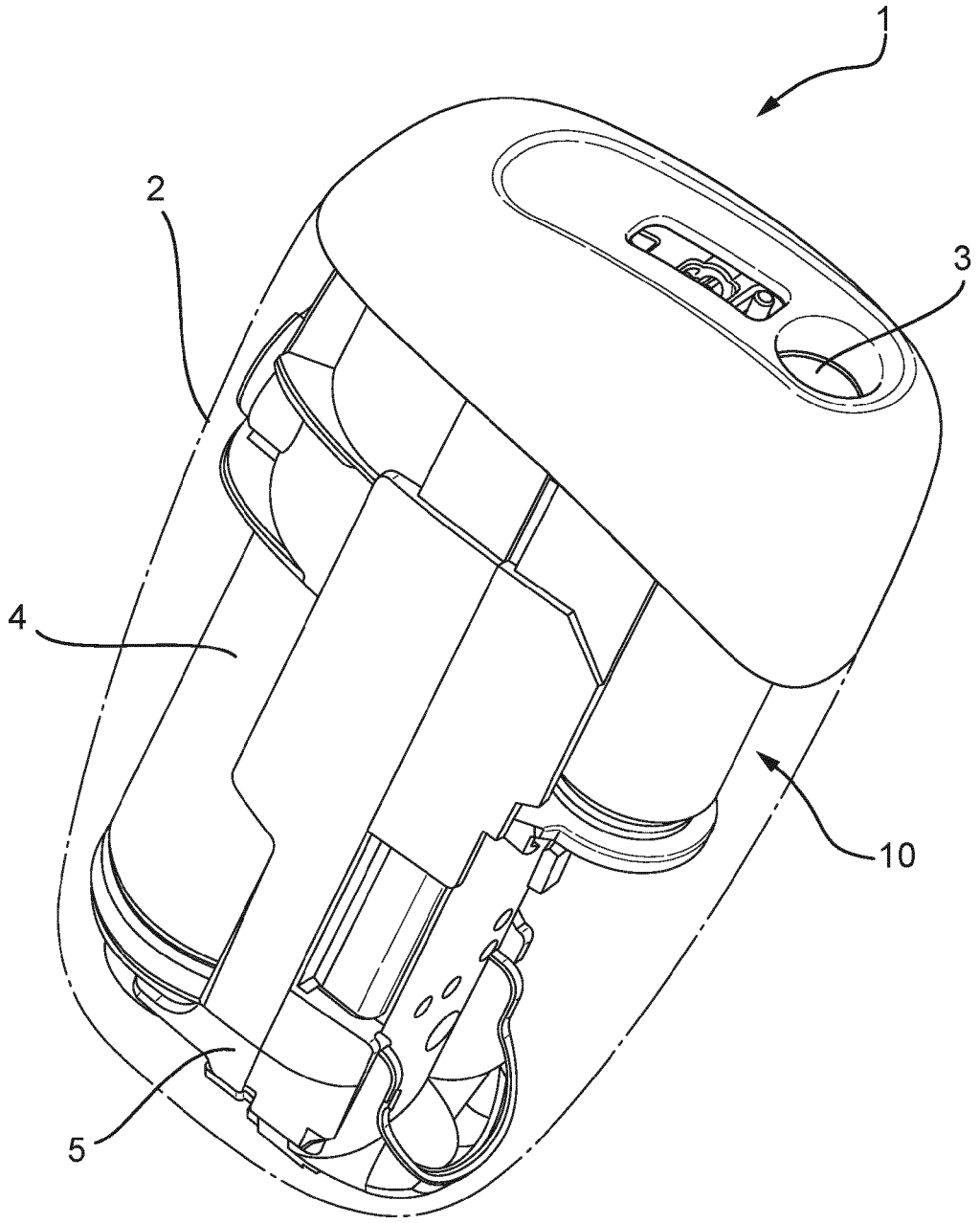
FIG. 1A schematically illustrates an example aerosol generating device in an assembled configuration.

An example aerosol generating device 1 is generally illustrated in an assembled configuration in FIG. 1A. The device 1 comprises an outer housing 2 having a bottom portion and a top portion. The top portion of the housing 2 is provided with an aperture 3 through which an aerosol-generating consumable can be inserted into the device 1.

Figure 1B:
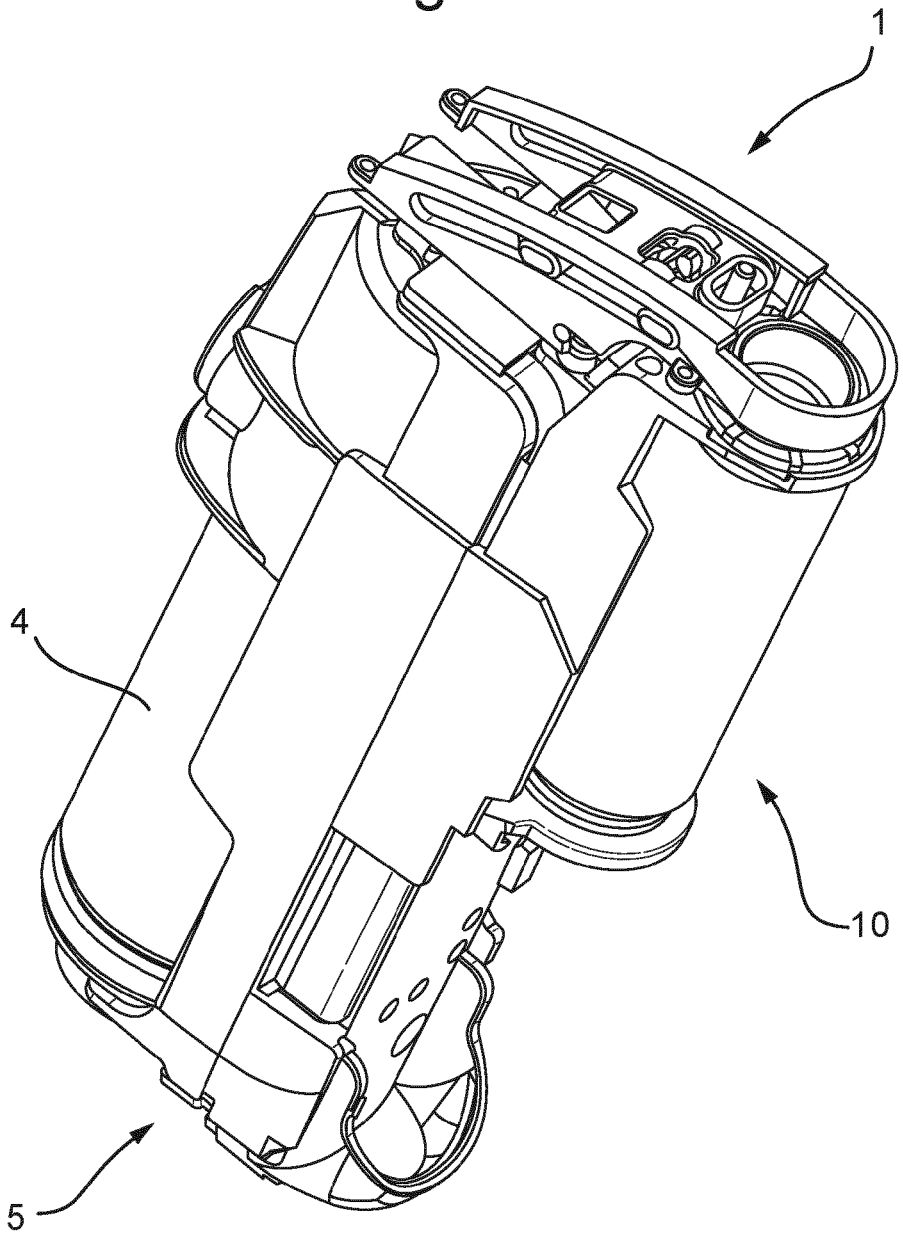
FIG. 1B schematically illustrates an example aerosol generating device with the internal components visible.

Inside the housing 2, the vapour generating device 1 comprises a battery 4 and a heater assembly 10. FIG. 1B illustrates the example device 1 without the outer housing 2. The battery 4 is operably connected to the heater assembly 10, such that the heater assembly 10 uses power supplied from the battery 4 to provide electrical heating. The device 1 generally includes a means for allows a user to control the supply of power from the battery 4 to the heater assembly 10 and to other components of the device. For example, in some examples the device 1 comprises a switch operable to manually adjust the level of power supplied from the battery 4. In other examples, the device 1 comprises a puff detector operable to sense when a user is taking a puff from the device 1, such that the power is supplied to the heater assembly 10 according to the timing in which the user has taken a puff. The battery 4, heater assembly 10 and various other components of the device 1 are held in place within the housing 2 by a support structure 5.

In use, a user holds the device 1 by the housing 2 and places a smokable, aerosol-generating consumable into, or near, the heater assembly of the device 1 through the aperture 3. The device 1 is then operated by a switch or by a puffing action from a user to turn on the power supply from the battery 4 to the heater assembly 10, so as to heat the consumable at or near the heater assembly 10. Heat generated at the heating assembly 10 causes the consumable to heat and release vapours which form an aerosol. The user can then inhale the aerosol, either through the consumable itself or through the aperture 3 of the device 1.

As noted above, the heater assembly 10 can often generate heat to high temperatures in order to vaporise, or aerosolise, the consumable in the device 1. The heater assembly 10 can typically reach between about 150° C. and about 300° C. The present invention, by careful design of the heater assembly 10 and surrounding structural components, reduces the leakage of heat from the heater assembly 10 to the housing 2 and other components of the device.

Figure 2A:
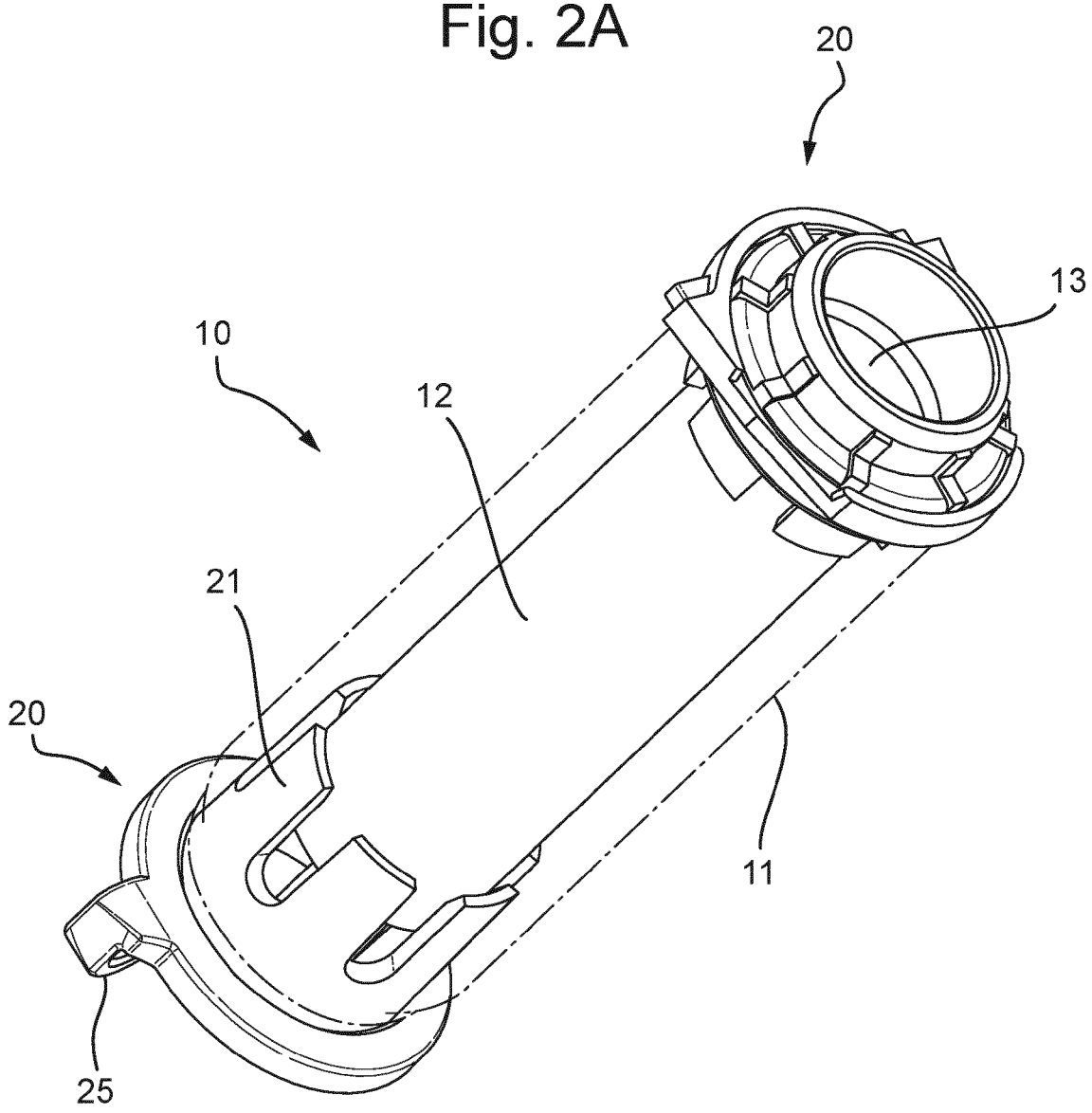
FIG. 2A schematically illustrates a first view of an example heating assembly.

An example heating assembly 10 is generally illustrated in an assembled configuration in FIG. 2A. The heating assembly 10 comprises an insulating tube 11, a heating chamber 12 and annular supports 20 holding the heating chamber 12 within the insulating tube 11 and holding the heater assembly to the support structure 5.

The insulating tube 11 is elongate and surrounds the heating chamber 12. The insulating tube 11 has an opening at one end which, when assembled within the housing of the device 1, is aligned with the aperture 3 of the device 1. Whilst the tube 11 in this example is open at both ends, in other examples the tube 11 can have a closed end opposing the end with an opening. The insulating tube 11 is arranged to insulate and contain the heat generated at the heating chamber 12, so that heat is more efficiently delivered to materials contained in the heating chamber 12, and so that other components of the device 1 are less exposed to heat generated at the chamber 12.

The heating chamber 12 is tubular and elongate, and is arranged to receive within its internal volume a smokable, aerosol generating consumable. The tubular heating chamber 12 has an open end 13 which, when assembled within the insulating tube 11 and the housing of the device 1, is aligned with both the aperture 3 and an open end of the insulating tube 11. As such, when the device is fully assembled, the internal volume of the chamber 12 is accessible through the aperture 3 and an open end of the tube 11.

Figure 2B:
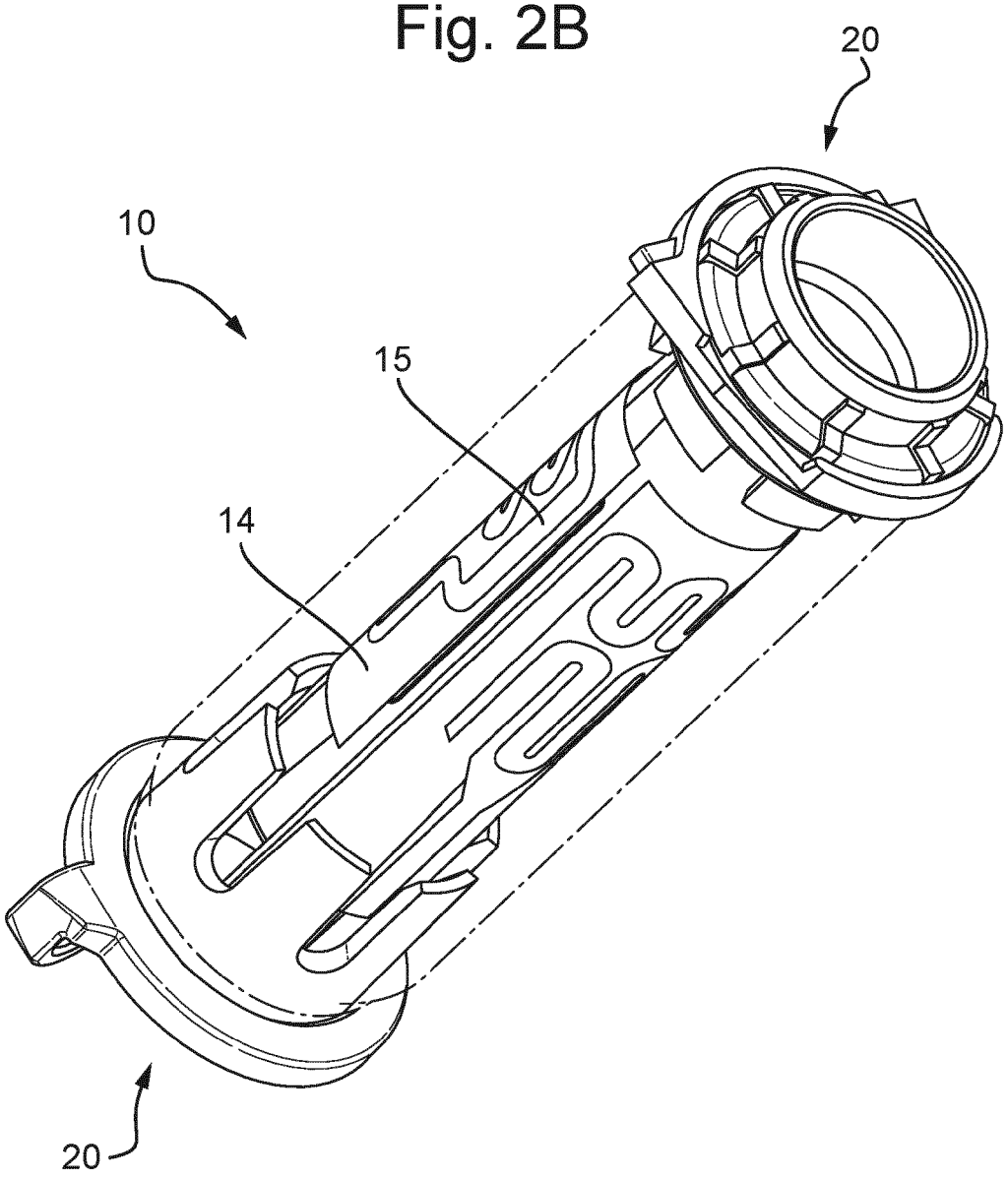
FIG. 2B schematically illustrates a second view of an example heating assembly.

A thin film heater 14 is wrapped around the heating chamber 12, and is arranged to provide heat at the chamber 12. Specifically, the heater 14 is wrapped around at least a portion of the circumference of the sheath of the tubular chamber 12 and is arranged to provide heat to the internal volume of the chamber 12. FIG. 2B illustrates the example heating assembly 10 with the heater 14 visible on the external surface of the chamber 12. In this example, the thin film heater 14 comprises a thin film circuit having resistive heating elements 15. The circuit, comprising the heating elements 15, is arranged to increase the surface area coverage of the heating elements 15 across the chamber 12 surface. As described above, the heating chamber 12 and the heater 14 in particular, are connected to the power supply 4 when assembled within the device 1.

The heating chamber 12 comprises a thermally conductive material, such as metal, to conduct heat from the heater 14 to the chamber 12.

The thin film heater 14 can be wrapped around and held against the outer surface of the heating chamber by a polyimide shrink wrap. In other examples, the thin film heater 14 can be affixed against the outer surface of the heating chamber by other means, such as by use of temperature resistant adhesives.

The tubular heating chamber 12 is held within the insulating tube 11 by annular supports 20 provided in this example at each of the ends of the tube 11. By annular, we intend to mean that the supports 20 have a generally annular cross section, having a generally circular cross-sectional outline with a central opening. The cross-sectional outline generally complements the cross-sectional shape of the insulating tube and/or the cross-sectional shape of the heating chamber. The cross-sectional outline of the supports 20 can be a completed circle or ellipse, or alternatively the cross-sectional outline can be C-shaped meaning that the cross-sectional outline has a break at one or more points along the circumference.

In this example heating assembly 10 there are two annular supports 20, one at each end of the insulating tube 11. Each annular support 20 comprises a plurality of protrusions 21 which extend into the insulating tube 11 to engage an outer surface of the heating chamber 12. In this example, the heating chamber 12 is held within the tube 11 by means of the protrusions 21 which engage the heating chamber 12 at an outer surface of each end of the chamber 12. The protrusions 21 can be annular or partially annular. Whilst the example of FIGS. 2A and 2B shows the annular supports 20 at the ends of the tube 11, in other examples the heater assembly 10 comprises annular supports 20 which are positioned along the central length of the insulating tube 11, such that the supports 20 are entirely surrounded by the insulating tube 11.

By employing the annular supports 20 to hold the heating chamber 12 within the insulating tube 11, an annular gap is created between the outer surface of the heating chamber 12 and the inner surface of the insulating tube 11. Thus, in addition to the insulating properties of the tube 11, the gap provides a further insulating layer to reduce the amount of heat transferred from the chamber 12 to the rest of the device 1. The annular supports 20 therefore provide structural support to reliably hold the heating chamber 12 within the insulating tube 11, and also provide additional insulation properties. The arrangement of the annular supports 20 further provides very small coverage of the external surface of the heater assembly 10 thereby allowing a large external surface of the insulating tube to be surrounded by an air gap in the outer housing 2.

Figure 3A:
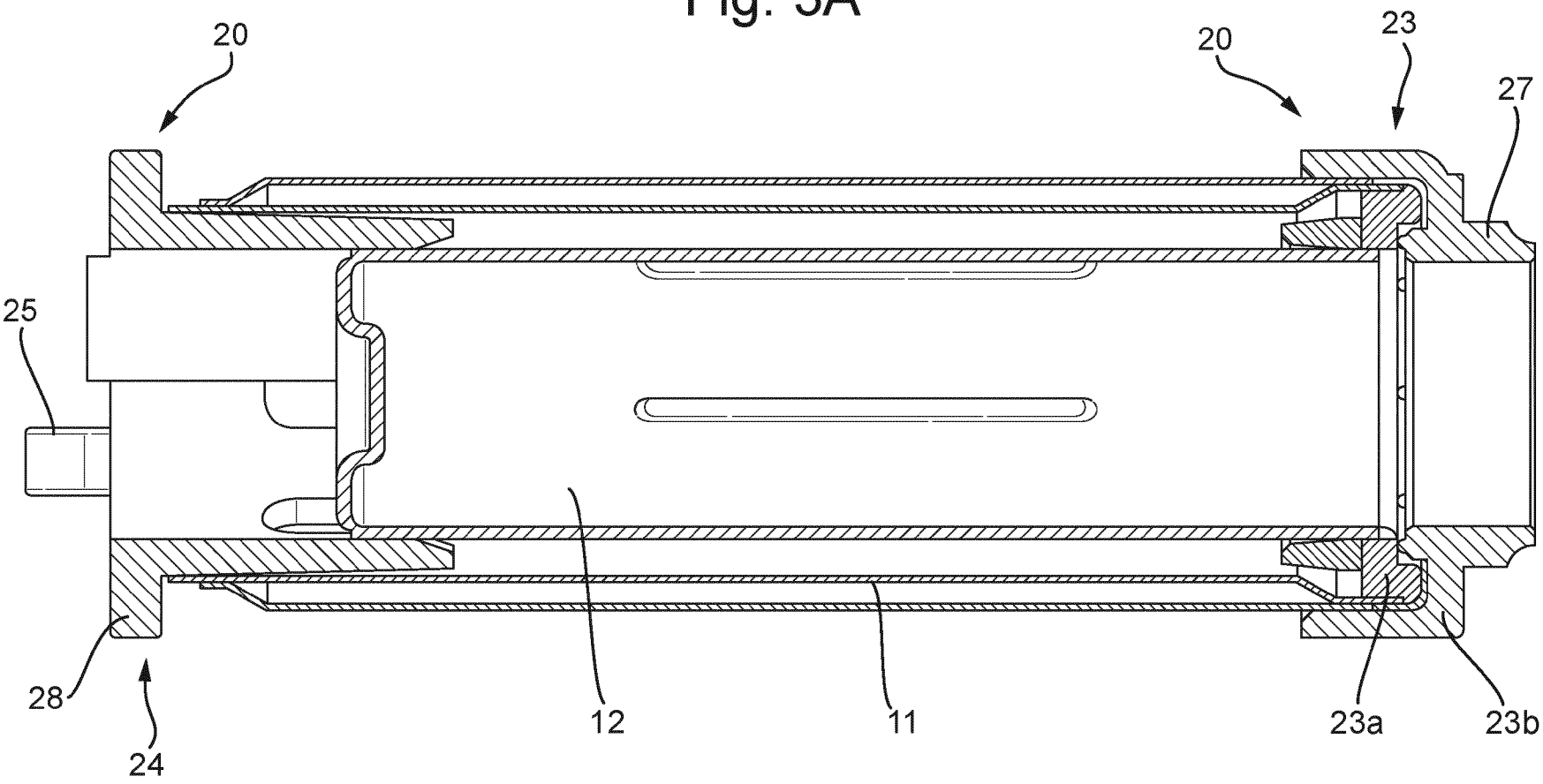
FIG. 3A schematically illustrates an example configuration of a heating assembly.
Figure 3B:
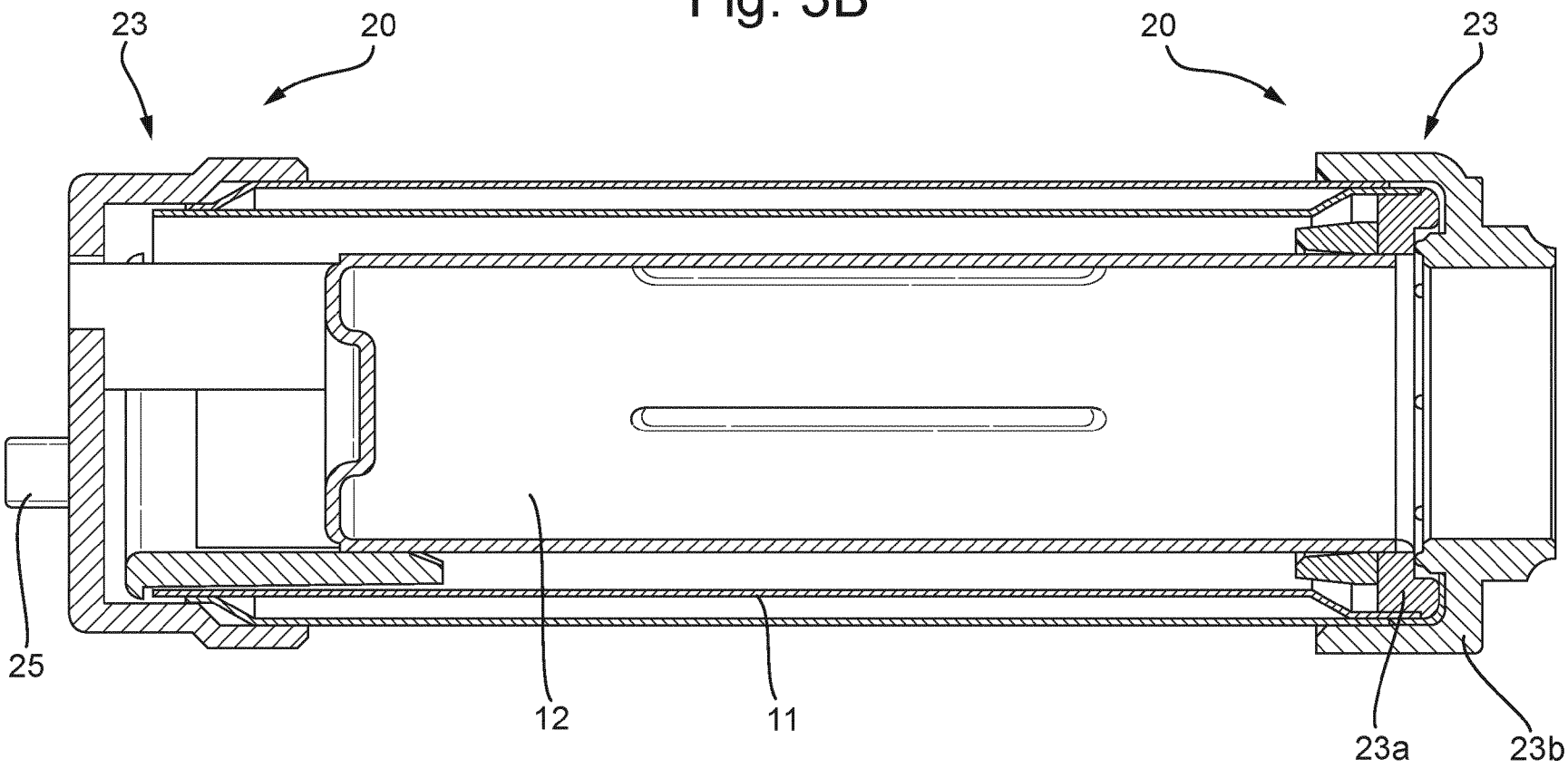
FIG. 3B schematically illustrates a further example configuration of a heating assembly.
Figure 3C:
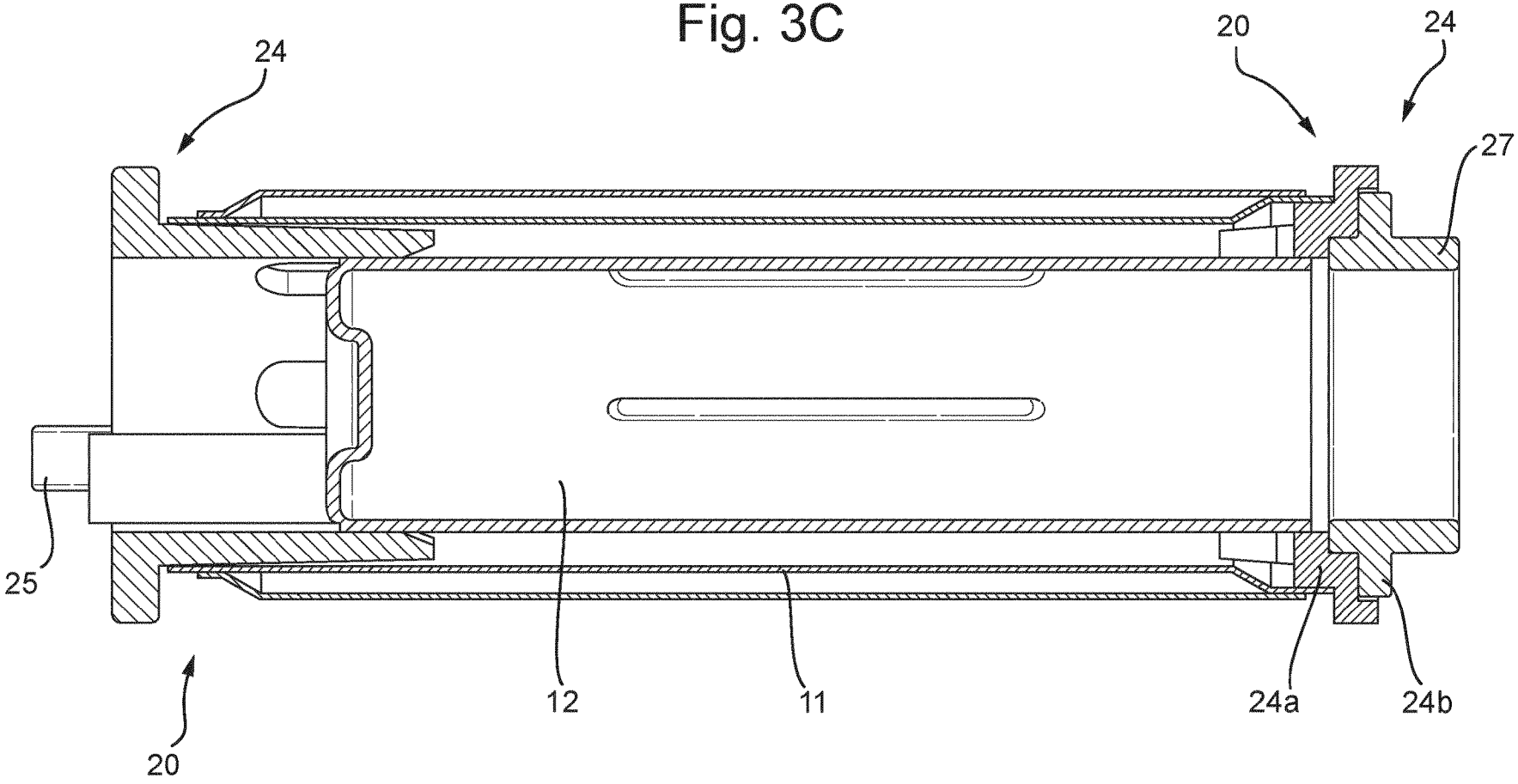
FIG. 3C schematically illustrates a further example configuration of a heating assembly.

The annular supports 20 shown in FIGS. 2A and 2B are arranged so as to engage an inner surface of the insulating tube 11, and to engage an outer surface of the heating chamber 12. In other examples, annular supports 20 may be provided to engage different sections of the components of the heater assembly 10. FIGS. 3A to 3C show various different arrangements and configurations of the annular supports 20.

Referring to FIG. 3A, an example heating assembly 10 is provided with annular supports 20 at each end of the insulating tube 11. In this example, one of the annular supports 20 is an outer annular support 23 which engages an outer surface of the insulating tube 11. In this particular example, a part of the outer annular support 23 is positioned outside of the insulating tube 11. As shown in the figure, the outer annular support 23 is positioned at a top end of the insulating tube 11. By 'top end' we intend to mean the end of the insulating tube 11 at which the open end of the heating chamber 12 is positioned. In use, an aerosol generating consumable is at least partially inserted into the chamber 12 through the top end of the insulating tube 11. The annular support 20 at the bottom end of the tube 11, i.e. the end of the insulating tube which opposes the top end, is an inner annular support 24 which only contacts the insulating tube 11 on its inner surface.

The outer annular support 23 may be modular and may comprise two components: a first support component 23*a* and a second support component 23*b*. As shown in the FIG. 3A, the first support component 23*a* contacts an outer surface of the heating chamber 12 to secure the chamber in position. In this example, the chamber 12 is held by the first support component 23*a* at the edge of the top end of the heating chamber 12. In other examples the first support component 23*a* can be arranged to hold the chamber 12 differently, such as by holding the chamber at an inner surface of the chamber 12, or by holding the chamber 12 at a defined distance from the edge of the top end of the chamber 12.

The second support component 23*b* engages the first support component 23*a* and also engages an outer surface of the insulating tube 11. The second component 23*b* is provided with an annular flange 27 which, in use, assists the insertion of a consumable into the chamber 12. The flange 27 can also be utilised to provide supporting structure or connection to other components in the device 1. The annular flange 27 may essentially extend axially to form a tubular extension aligned with the tubular heating chamber 12.

The first support component 23*a* and the second support component 23*b* are in engagement with each other at one or more contact points, so as to be secured against each other. As such, the outer annular support 23 holds the heating chamber 12 against the insulating tube 11. The total surface area of the contact points is minimised in order to minimise the direct physical contact, and therefore to minimise the thermal conduction between the first and second components 23*a*, 23*b*. In this way, the conduction of heat from the heating chamber 12 out to the insulating tube 11 can be reduced so as to further improve insulation of heat. It can be seen from the cross-sectional view of the example shown in FIG. 3A that the first and second components 23*a*, 23*b* are only in contact at a reduced surface, preferably at a small contact point. The contact points can be arranged as discrete contact points, or as one or more arced lines or continuous line, around the circumference of the tube.

As illustrated in this example, the inner annular support 24 is provided at a bottom end of the insulating tube and comprises an annular protrusion 21 which extends into the insulating tube. The protrusion 21 of the inner annular support 24 holds the heating chamber 12 in place within the insulating tube 11.

Figure 4:
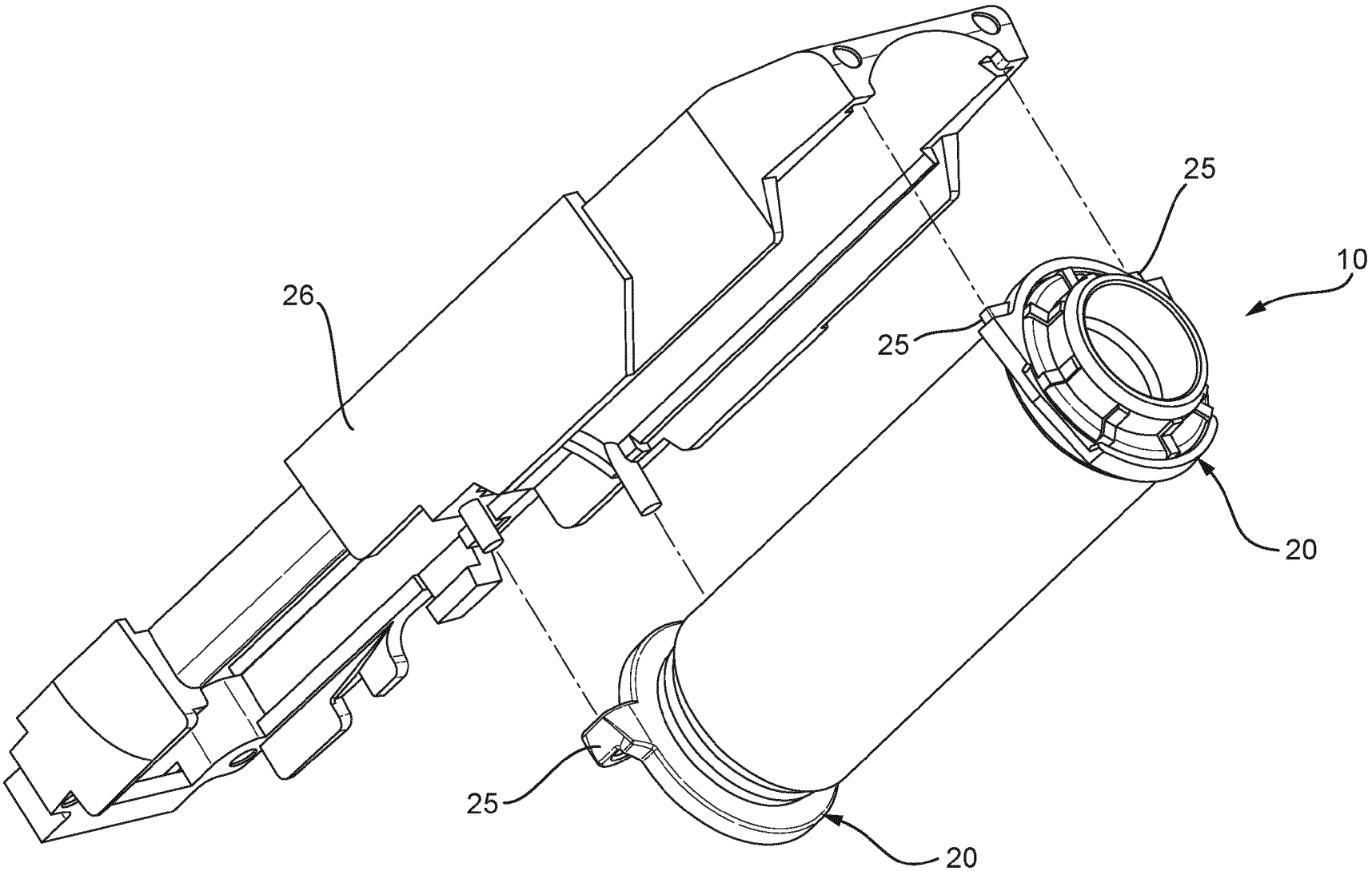
FIG. 4 schematically illustrates an example heating assembly with an example frame.

The inner annular support 24 comprises an outer collar 28. The outer collar 28 extends outwardly from the protrusion 21 and protrudes axially beyond the insulating tube to allow the heater assembly to be mounted to frame 26. The inner support 24 is preferably provided with a connection member 25 for mounting the heater assembly 10 to a frame 26 within the device 1. Such connection member can extend from the collar 28 such as radially in this example. The frame 26 can be part of, or attached to, a support structure 5 which holds a number of components within the device 1 (e.g. battery, control circuitry board, sensors, etc.). The mounting of the heater assembly 10 within the frame 26 is illustrated in FIG. 4 and will be described later in more detail. Whilst in this example the inner annular support 24 is provided with the connection members 25, in other examples connection members 25 are provided on the outer annular support 23 instead of or in combination with the connection members 25 on the inner annular support 24.

As described above, the example shown in FIG. 3A comprises an outer annular support 23 at a top end of the heating chamber 12 and insulating tube 11, and an inner annular support 24 at a bottom end of the heating chamber 12 and insulating tube 11. Other examples having alternative arrangements and configurations of the inner and outer annular supports are also possible. For example, FIG. 3B illustrates an example heating assembly 10 which comprises two outer annular supports 23. Each of the annular supports, positioned at either end of the insulating tube 11, holds the heating chamber 12 from outside the insulating tube 11. Similarly, the example illustrated in FIG. 3C comprises two inner annular supports 24. The inner annular supports 24 extend into the insulating tube 11 and hold the heating assembly 12 from the inside of the insulating tube 11. In this example, the inner annular support 24 provided at the top end of the insulating tube 11 is comprised of two components, in a similar manner to the outer annular support 23 of FIG. 3A. A first component 24*a* of the inner annular support 24 is in engagement with the heating chamber, whilst a second component 24*b* of the inner annular support is not in contact with any of the other components of the heater assembly 10. The first and second components are in engagement along contact points in a similar manner to that of the outer annular support 23 of FIG. 3A, in order to minimise conduction of heat.

As noted above, some or all of the annular supports 20 of the heater assembly 10 can be provided with connection members 25 for securing the assembly 10 to a frame 26. The connection members 25 typically comprise one or more apertures, each arranged to receive a securing pin from the frame 26. The connection members 25 are therefore arranged to secure the heater assembly 10 to the frame 5 by a slot-and-hole connection. As shown in FIG. 4, when assembling the device 1, the heater assembly 10 is positioned so as to align with the geometry of the frame 26, and the two parts are connected by slotting the pins of the frame 26 into the apertures 25 provided at the supports 20. The intended slotting action is shown by the dotted lines in FIG. 4. Once slotted in place, the connection between the pins of the frame 5 and the apertures 25 of the heater assembly 10 are tight and strong enough to hold the assembly 10 against the frame 5. The frame 5 can be assembled, together with the other components of the device 1, to achieve the device illustrated in FIG. 1A, for example. In the invention, the frame 26 is preferably an element independent from the outer housing so as to reduce thermal and mechanical constraints on housing. However, in a less preferred mode, the frame may an integral internal part of the outer housing.

As will be appreciated from the above, the present invention, by providing the functionalities of a heater assembly having annular supports capable of providing improved insulation between the heating chamber and the rest of the device, enables significantly improved heating performance. The ability to contain the majority of generated heat within the heating chamber and/or the insulating tube contributes to a significantly improved heating efficiency, as well as improved safety of the device as a whole. With its improved insulation capabilities, the device comprising a heating assembly as described above has significantly reduced leakage of heat through the device, which means the components inside the device are safer and less prone to damage, and the outer casing of the device can be maintained at a lower temperature comfortable for the user to hold. An aerosol generating device with improved heating performance and above advantages is achieved by the invention, whilst still providing excellent heating and vapour provision functionalities of such a device.

Definitions and Alternative Embodiments

It will be appreciated from the description above that many features of the described embodiment perform independent functions with independent benefits. Therefore the inclusion or omission of each of these independent features from embodiments of the invention defined in the claims can be independently chosen.

The term "heater" should be understood to mean any device for outputting thermal energy sufficient to form an aerosol from the aerosol substrate. The transfer of heat energy from the heater 14 to the aerosol substrate may be conductive, convective, radiative or any combination of these means. As non-limiting examples, conductive heaters may directly contact and press the aerosol substrate, or they may contact a separate component such as the heating chamber which itself causes heating of the aerosol substrate by conduction, convection, and/or radiation.

Heaters may be electrically powered, powered by combustion, or by any other suitable means. Electrically powered heaters may include resistive track elements (optionally including insulating packaging), induction heating systems (e.g. including an electromagnet and high frequency oscillator), etc. The heater 14 may be arranged around the outside of the aerosol substrate, it may penetrate part way or fully into the aerosol substrate, or any combination of these. For example, instead of the heater of the above-described embodiment, an aerosol generation device may have a blade-type heater that extends into an aerosol substrate in the heating chamber.

Aerosol substrate includes tobacco, for example in dried or cured form, in some cases with additional ingredients for flavouring or producing a smoother or otherwise more pleasurable experience. In some examples, the aerosol substrate such as tobacco may be treated with a vaporising agent. The vaporising agent may improve the generation of vapour from the aerosol substrate. The vaporising agent may include, for example, a polyol such as glycerol, or a glycol such as propylene glycol. In some cases, the aerosol substrate may contain no tobacco, or even no nicotine, but instead may contain naturally or artificially derived ingredients for flavouring, volatilisation, improving smoothness, and/or providing other pleasurable effects. The aerosol substrate may be provided as a solid or paste type material in shredded, pelletised, powdered, granulated, strip or sheet form, optionally a combination of these. Equally, the aerosol substrate may be a liquid or gel. Indeed, some examples may include both solid and liquid/gel parts.

Consequently, the aerosol generation device 1 could equally be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol substrate.

The aerosol generation device 1 may be arranged to receive the aerosol substrate in a pre-packaged substrate carrier. The substrate carrier may broadly resemble a cigarette, having a tubular region with an aerosol substrate arranged in a suitable manner. Filters, vapour collection regions, cooling regions, and other structure may also be included in some designs. An outer layer of paper or other flexible planar material such as foil may also be provided, for example to hold the aerosol substrate in place, to further the resemblance of a cigarette, etc. The substrate carrier may fit within the heating chamber 12 or may be longer than the heating chamber 12. In such examples, the aerosol may be provided directly from the substrate carrier which acts as a mouthpiece for the aerosol generation device.

As used herein, the term "volatile" means a substance capable of readily changing from the solid or liquid state to the gaseous state. As a non-limiting example, a volatile substance may be one which has a boiling or sublimation temperature close to room temperature at ambient pressure. Accordingly "volatilize" or "volatilise" shall be construed as meaning to render (a material) volatile and/or to cause to evaporate or disperse in vapour.

As used herein, the term "vapour" (or "vapor") means: (i) the form into which liquids are naturally converted by the action of a sufficient degree of heat; or (ii) particles of liquid/moisture that are suspended in the atmosphere and visible as clouds of steam/smoke; or (iii) a fluid that fills a space like a gas but, being below its critical temperature, can be liquefied by pressure alone.

Similarly, the term "vaporise" (or "vaporize") means: (i) to change, or cause the change into vapour; and (ii) where the particles change physical state (i.e. from liquid or solid into the gaseous state).

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. An aerosol generating device comprising a heater assembly and a frame configured to hold the heater assembly; the heater assembly comprising:

a tubular heating chamber for heating aerosol generating material contained within the tubular heating chamber, the tubular heating chamber comprising a tubular wall defining therewithin an internal volume configured to receive the aerosol generating material;

an insulating tube at least partially sleeved around the tubular heating chamber; and at least one annular support for supporting the tubular heating chamber within the insulating tube, wherein at least a portion of the at least one annular support is mounted within the insulating tube, and the tubular heating chamber is at least partially mounted within the at least one annular support, and wherein the at least one annular support is positioned at one end of the insulating tube and configured to be mounted to the frame.

2. The aerosol generating device according to claim 1, wherein each annular support of the at least one annular support comprises one or more protrusions extending into the insulating tube to engage an outer surface of the tubular heating chamber.

3. The aerosol generating device according to claim 1, wherein the at least one annular support includes one annular support at each end of the insulating tube.

4. The aerosol generating device according to claim 3, wherein the heater assembly is free of any annular support between the annular supports at each end of the insulating tube.

5. The aerosol generating device according to claim 1, wherein at least one of the at least one annular support is an outer annular support which engages an outer surface of the insulating tube.

6. The aerosol generating device according to claim 5, wherein the outer annular support comprises a first support component and a second support component, wherein the first support component engages a portion of the outer surface of the insulating tube;

the second support component engages a portion of an outer surface of the tubular heating chamber within the insulating tube; and the first support component and the second support component engage each other at one or more contact points.

7. The aerosol generating device according to claim 6, wherein the first support component and the second support component engage each other along a contact line.

8. The aerosol generating device according to claim 1, wherein at least one of the at least one annular support is an inner annular support which only contacts the insulating tube on an inner surface thereof.

9. The aerosol generating device according to claim 1, wherein the at least one annular support includes a first annular support at a first end of the insulating tube, and a second annular support at a second end of the insulating tube.

10. The aerosol generating device according to claim 5, wherein at least one of the at least one annular support is an inner annular support at a first end of the insulating tube and which only contacts the insulating tube on an inner surface thereof, and wherein the outer annular support is at a second end of the insulating tube.

11. The aerosol generating device according to claim 1, wherein the at least one annular support includes an outer annular support at each end of the insulating tube, wherein each outer annular support engages an outer surface of the insulating tube.

12. The aerosol generating device according to claim 1, wherein the at least one annular support includes an inner annular support at each end of the insulating tube, wherein each inner annular support only contacts the insulating tube on an inner surface thereof.

13. The aerosol generating device according to claim 1, wherein at least one of the at least one annular support comprises a connection member for securing the heater assembly to the frame.

14. The aerosol generating device according to claim 13, wherein the connection member comprises an aperture arranged to receive one or more pins provided on the frame.

15. The aerosol generating device according to claim 1, further comprising a thin film heater wrapped around an outer surface of the tubular heating chamber.

* * * * *